US011823611B2

(12) United States Patent
Shibazaki

(10) Patent No.: US 11,823,611 B2
(45) Date of Patent: Nov. 21, 2023

(54) DISPLAY DEVICE INCLUDING DISPLAY CONTROL CIRCUIT AND METHOD FOR CONTROLLING THEREOF

(71) Applicant: Sharp Display Technology Corporation, Kameyama (JP)

(72) Inventor: Akira Shibazaki, Kameyama (JP)

(73) Assignee: SHARP DISPLAY TECHNOLOGY CORPORATION, Kameyama (JP)

( * ) Notice: Subject to any disclaimer, the term of this patent is extended or adjusted under 35 U.S.C. 154(b) by 0 days.

(21) Appl. No.: 17/717,230

(22) Filed: Apr. 11, 2022

(65) Prior Publication Data

US 2022/0351668 A1 Nov. 3, 2022

(30) Foreign Application Priority Data

Apr. 28, 2021 (JP) ..... 2021-076051

(51) Int. Cl.
*G09G 3/20* (2006.01)
*G09G 3/36* (2006.01)

(52) U.S. Cl.
CPC ..... *G09G 3/2092* (2013.01); *G09G 3/3648* (2013.01); *G09G 2300/0842* (2013.01); *G09G 2310/065* (2013.01); *G09G 2330/021* (2013.01); *G09G 2360/16* (2013.01)

(58) Field of Classification Search
CPC ..... G09G 3/2092; G09G 3/3648; G09G 2300/0842; G09G 2310/065; G09G 2330/021; G09G 2360/16
See application file for complete search history.

(56) References Cited

U.S. PATENT DOCUMENTS

2004/0113879 A1* 6/2004 Sekiguchi ..... G09G 3/3648 345/94

FOREIGN PATENT DOCUMENTS

JP 2002-182619 A 6/2002

* cited by examiner

*Primary Examiner* — Adam J Snyder
(74) *Attorney, Agent, or Firm* — KEATING & BENNETT, LLP

(57) ABSTRACT

A display device includes a display control circuit. The display control circuit includes: an arithmetic unit obtaining a video signal, and calculating, in accordance with the video signal, an average voltage value of a source signal in a display period; and a controller and a signal synthesizer supplying, in the display period, a source signal, based on the video signal, from a source drive circuit to a plurality of source lines, and supplying, in a suspension period, a source signal, having the average voltage value, from a source drive circuit to each of the source lines.

7 Claims, 5 Drawing Sheets

DISPLAY DEVICE INCLUDING DISPLAY CONTROL CIRCUIT AND METHOD FOR CONTROLLING THEREOF

CROSS-REFERENCE TO RELATED APPLICATIONS

This application claims the benefit of priority to Japanese Patent Application Number 2021-076051 filed on Apr. 28, 2021. The entire contents of the above-identified application are hereby incorporated by reference.

TECHNICAL FIELD

The present disclosure relates to a display device and a method for controlling thereof.

BACKGROUND ART

A display device including a plurality of thin-film transistors and a method for controlling the display device are known in the art. Such a display device and a method are disclosed in, for example, Patent Document 1.

The display device of Patent Document 1 includes: data signal lines and gate signal lines connected to the thin-film transistors; pixel electrodes; and common electrodes. Moreover, this display device includes: a source driver supplying a data signal to each of the data signal lines; a gate driver supplying a gate signal to each of the gate signal lines; and a control IC controlling the source driver and the gate driver. In this display device, a scan period and a suspension period are alternated by control of the control IC. Here, the scan period is to supply a gate signal to a gate signal line by the gate driver, and the suspension period is a period until a gate-start-pulse signal is input to the gate driver next time. This display device operates on dot-inversion drive that involves reversing a voltage polarity of the data signal line several times within one scan period. In this display device, the suspension period is taken longer than the scan period so that performed on this display device is low-frequency drive in which a period per frame is long.

CITATION LIST

Patent Literature

[Patent Document] Japanese Unexamined Patent Application Publication No. 2002-182619

SUMMARY OF INVENTION

Technical Problems

In order to perform the dot-inversion drive, the display device in Patent Document 1 described above has to reverse the voltage polarity of a source signal for each horizontal period, inevitably causing an increase in power consumption. Hence, in order to decrease the power consumption, the display device would be configured to perform column-inversion drive to reverse the voltage polarity of the source signal for every one frame period. Compared with the dot-inversion drive, in the column-inversion drive, the frequency of the source driver at the polarity reverse is one over the vertical pixel count. As a result, the power consumption can be reduced.

However, when the display device performing the column-inversion drive and the low-frequency drive is used for a long time, the thin-film transistors of the display device could deteriorate. In such a case, the deteriorating thin-film transistors suffer an increase in current leakage when the transistors are OFF (i.e. the OFF characteristics worsen.) Then, in the display device including the deteriorating thin-film transistors, the potential of the pixel electrodes varies because of the current leakage. The potential variation causes such problems as variance in luminance, appearance of a bright spot, and the resulting deterioration in display quality.

The present disclosure is conceived in view of the above problems, and is intended to provide a display device and a method for controlling the display device. While reducing power consumption, the display device is capable of maintaining display quality even if a thin-film transistor deteriorates.

Solution to Problems

In order to solve the above problems, a display device according to a first aspect of the present disclosure includes: a plurality of gate lines; a plurality of source lines arranged to intersect with the gate lines; a plurality of thin-film transistors connected to the gate lines and the source lines; a plurality of pixel electrodes connected to the thin-film transistors; a gate drive circuit sequentially supplying a gate signal to the gate lines; a source drive circuit supplying a source signal to the source lines, and performing column-inversion drive to reverse a polarity of a voltage of the source signal for every one frame period; and a display control circuit controlling the gate drive circuit and the source drive circuit. The one frame period includes: a display period for sequentially supplying the gate signal to the gate lines; and a suspension period for suspending supply of the gate signal. The display control circuit includes: an arithmetic unit obtaining a video signal, and calculating, in accordance with the video signal, an average voltage value or a mode voltage value of the source signal in the display period, the average voltage value or the mode voltage value being calculated for each of the source lines; and a source controller supplying, in the display period, the source signal, based on the video signal, from the source drive circuit to the source lines, and supplying, in the suspension period, a source signal, having the average voltage value or the mode voltage value calculated by the arithmetic unit, from the source drive circuit to each of the source lines.

Moreover, in a method for controlling a display device according to a second aspect, the display device includes: a plurality of gate lines; a plurality of source lines arranged to intersect with the gate lines; a plurality of thin-film transistors connected to the gate lines and the source lines; and a plurality of pixel electrodes connected to the thin-film transistors. The method includes: a step of sequentially supplying a gate signal to the gate lines; and a step of supplying a source signal to the source lines. The step of supplying the source signal includes a step of performing column-inversion drive to reverse a polarity of a voltage of the source signal for every one frame period. The one frame period includes: a display period for sequentially supplying the gate signal to the gate lines; and a suspension period for suspending supply of the gate signal. The method further includes: a step of obtaining a video signal, and calculating, based on the video signal, an average voltage value or a mode voltage value of the source signal in the display period, the average voltage value or the mode voltage value being calculated for each of the source lines; and a step of supplying, in the display period, the source signal, based on the video signal, to the source lines, and supplying, in the suspension period, a source signal, having the average voltage value or the mode voltage value calculated in the step of calculating, to each of the source lines.

Advantageous Effects of Invention

The above features make it possible to provide a display device capable of maintaining display quality even if thin-film transistors deteriorate, while reducing power consumption.

DESCRIPTION OF EMBODIMENTS

Described below in detail are embodiments of the present disclosure, with reference to the drawings. Like reference signs designate identical or corresponding components throughout the drawings. Such components will not be elaborated upon repeatedly. Note that, for the sake of brief explanation, the drawings to be referred to below are simplistically or schematically illustrated, and some of the constituent members are omitted. Moreover, a dimension ratio between constituent members in each drawing does not necessarily indicate an actual dimension ratio.

First Embodiment (Overall Configuration of Display Device)

Figure 1:
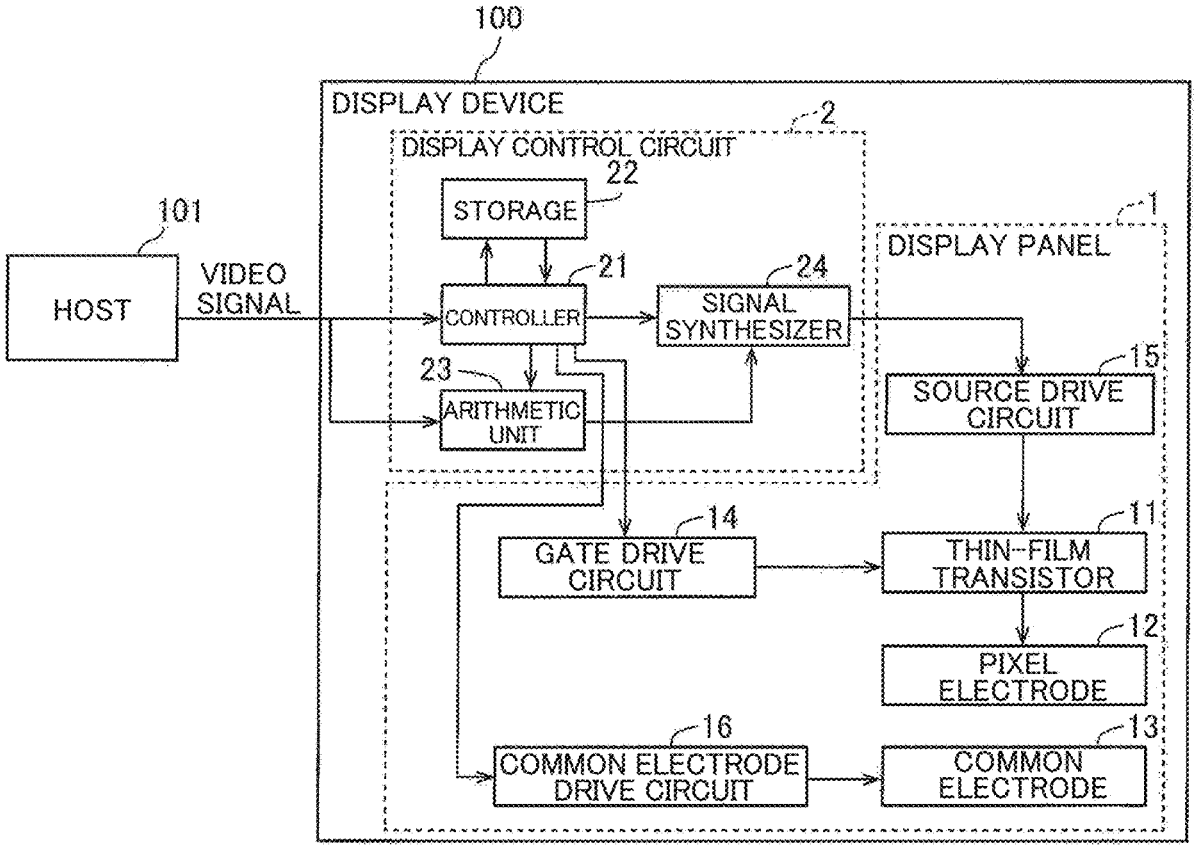
FIG. 1 is a block diagram illustrating a configuration of a display device according to a first embodiment.

FIG. 1 shows a configuration of a display device 100 according to a first embodiment. FIG. 1 is a block diagram illustrating a functional configuration of the display device 100 according to this embodiment.

As illustrated in FIG. 1, the display device 100 includes: a display panel 1; and a display control circuit 2. The display panel 1 is, for example, a liquid crystal display to display a video or an image. The display control circuit 2 performs control processing for the display of the display panel 1. The display device 100 receives a video signal from a host 101.

Figure 2:
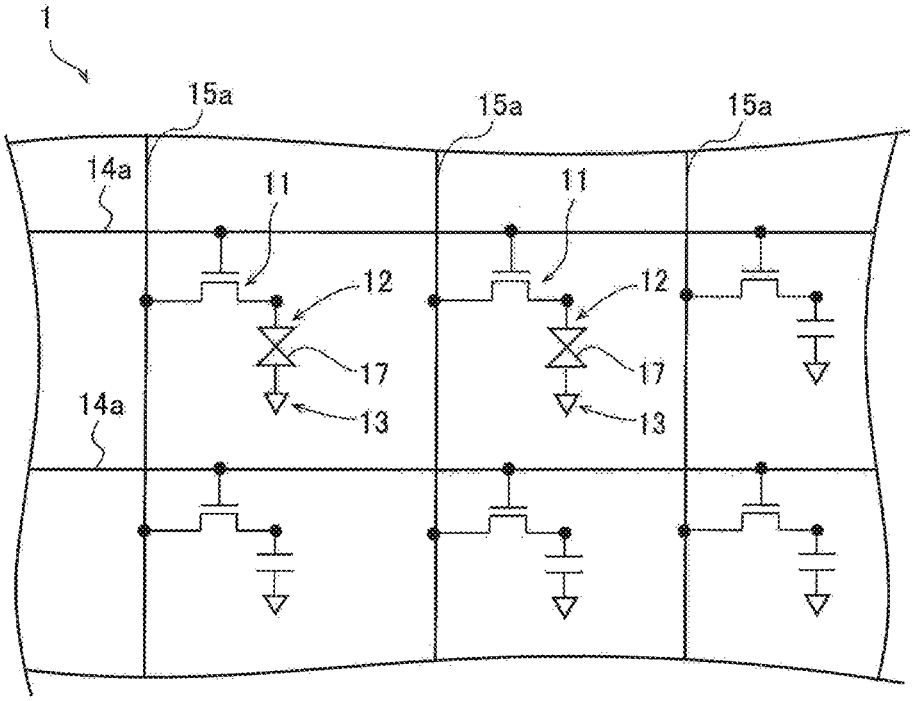
FIG. 2 is a diagram showing a configuration of a part of a display panel.

As illustrated in FIG. 1, the display panel 1 includes: a thin-film transistor 11: a pixel electrode 12; a common electrode 13; a gate drive circuit 14; a source drive circuit 15; and a common electrode drive circuit 16. FIG. 2 is a plan view schematically showing a configuration of a part of the display panel 1. As illustrated in FIG. 2, the display panel 1 includes: a plurality of gate lines 14*a* connected to the gate drive circuit 14 (see FIG. 1); and a plurality of source lines 15*a* connected to the source drive circuit 15 (see FIG. 1). The gate lines 14*a* and the source lines 15*a* are formed in a grid pattern. The gate lines 14*a* and the source lines 15*a* define regions (pixels) each including the thin-film transistor 11 and the pixel electrode 12. Moreover, the display panel 1 includes a plurality of the common electrodes 13 disposed to face the pixel electrodes 12. The common electrodes 13 are provided in common among the pixel electrodes 12, and form capacitance between the common electrodes 13 and the pixel electrodes 12. Moreover, the display panel 1 includes liquid crystal layers 17. The liquid crystal layers 17 are driven by electric fields generated by the pixel electrodes 12 and the common electrodes 13, and display a video or an image on the display panel 1.

As illustrated in FIG. 1, the display control circuit 2 controls the gate drive circuit 14, the source drive circuit 15, and the common electrode drive circuit 16. Specifically, in accordance with an instruction from the display control circuit 2, the gate drive circuit 14 sequentially supplies a gate signal (a scan signal) to each of the gate lines 14*a*. Moreover, in accordance with an instruction from the display control circuit 2, the source drive circuit 15 supplies a source signal to each of the source lines 15*a*. Hence, the thin-film transistor 11 supplied with the gate signal turns ON, and the source signal (data) is written to the pixel electrode 12. Here, in the first embodiment, the source drive circuit 15 performs column-inversion drive (see FIG. 3) to reverse a polarity of a voltage of the source signal for every one frame. Hence, the column-inversion drive of the first embodiment can further reduce power consumption of the display device 100 than dot-inversion drive. Moreover, in accordance with an instruction from the display control circuit 2, the common electrode drive circuit 16 supplies a drive signal to the common electrodes 13.

Furthermore, as illustrated in FIG. 1, the display control circuit 2 includes: a controller 21; a storage 22; an arithmetic unit 23; and a signal synthesizer 24. The display controller 2 may be one integrated circuit, or a plurality of integrated circuits. The controller 21 at least temporarily stores, on the storage 22, the video signal input from the host 101. Moreover, the controller 21 determines timings of the controls performed by the display control circuit 2. For example, the controller 21 reads the video signal out from the storage 22, and synchronizes a timing to output, to the signal synthesizer 24, a first output signal based on the read video signal, a timing to output a second output signal from the arithmetic unit 223 to the signal synthesizer 24, and a timing to start scanning by the gate drive circuit 14. The storage 22 is a memory circuit to store the video signal. For example, the storage 22 is a line memory capable of inputting and outputting each of the data items corresponding to respective source signals. The arithmetic unit 23 computes (calculates) an average value of the input data. In accordance with an instruction of the controller 21, the signal synthesizer 24 synthesizes the first output signal and the second output signal into a signal (a source control signal), and supplies the synthesized source control signal to the source drive circuit 15.

Figure 3:
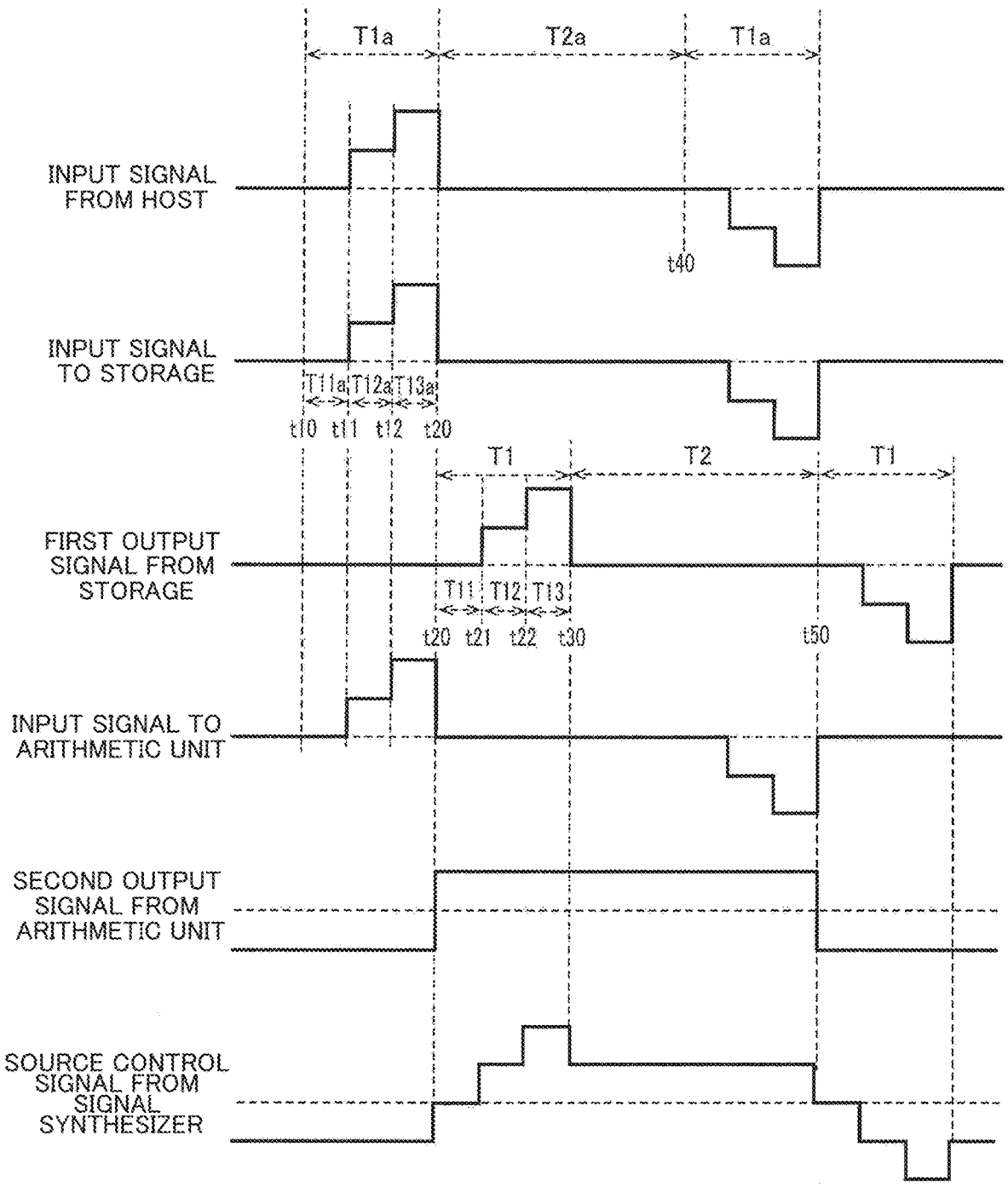
FIG. 3 illustrates timing diagrams of signals input to, and output from, a display control circuit.

FIG. 3 illustrates timing diagrams showing timings at which signals are input to, and output from, the display control circuit 2. Note that FIG. 3 shows input and output of signals for generating one source signal. A source signal is individually output to each of the not-shown source lines 15*a*. Here, as illustrated in FIG. 3, the display control circuit 2 alternates a display period T1 and a suspension period T2 for every one frame. The display period T1 is a period (a scan period) in which a gate signal is sequentially supplied to the gate lines 14*a*. Moreover, the suspension period T2 is a period (a scan period) in which a gate signal is not sequentially supplied to the gate lines 14*a*.

For example, FIG. 3 shows an example of a waveform of a video signal to be input from the host 101. FIG. 3 shows an example that the video signal to be input from the host 101 includes, as data in a display period T1*a*: data of a voltage value with a 0-level grayscale in a period T11*a* from a time point t10 to a time point t11; data of a voltage value with a 128-level grayscale in a period T12*a* from the time point t11 to a time point t12; data of a voltage value with a 255-level grayscale in a period T13*a* from the time point t12 to a time point T13*a*. Moreover, the video signal to be input (received) from the host 101 includes, as data in a suspension period T2*a*, data of a voltage value with a 0-level grayscale in a period from a time point t20 to a time point t40. Note that the grayscale levels are examples, and shall not be limited to these grayscale levels.

Moreover, FIG. 3 shows an example of a waveform of a video signal to be input to the storage 22, and an example of a waveform of the first output signal to be output from the storage 22. Furthermore, FIG. 3 shows an example of a waveform of a video signal to be input to the arithmetic unit 23, and an example of a waveform of the second output signal to be output from the arithmetic unit 23. Furthermore, FIG. 3 shows an example of a waveform of a source control signal to be output from the signal synthesizer 24.

As illustrated in FIG. 3, in the display period T1*a* from the time point t10 to the time point t20, the controller 21 obtains the video signal from the host 101 and inputs the video signal to the storage 22. Moreover, in the period T1*a* from the time point t10 to the time point t20, the arithmetic unit 23 calculates, for each of the source lines 15*a*, an average value (e.g. an arithmetic average value) of voltage values (grayscale levels) of the source signal in the display period T1*a* of the video signal. For example, the arithmetic unit 23 divides a sum of the grayscale values of the source signals for all the stages of the gate lines 14*a* by the number of the lines of the gate lines 14*a*, to calculate the average value for each of the source lines 15*a*. For example, when the display panel 1 is provided with 1920 source lines 15*a*, the arithmetic unit 23 calculates each average value of the source signals to be supplied to the 1920 source lines 15*a*.

Then, as illustrated in FIG. 3, the display control circuit 2 sequentially starts supplying a gate signal to the gate lines 14*a* (see FIG. 2) at the time point 20 after the time point t10, in order to start the display period T1. That is, the display control circuit 2 starts the display period T1 after the starting time point t10 of the display period T1*a* for the video signal to be supplied from the host 101.

Moreover, in the period T11 from the time point t20 to a time point t21, a signal (the first output signal) is output from the storage 22 to the signal synthesizer 24. The signal is used for generating a source signal corresponding to the voltage value with the 0-level (V0) grayscale. In a period T12 from the time point t21 to a time point t22, the first output signal, corresponding to the voltage value with the 128-level grayscale (V128), is output from the storage 22 to the signal synthesizer 24. In a period T13 from the time point t22 to a time point t30, the first output signal, corresponding to the voltage value with the 255-level grayscale (V255), is output from the storage 22 to the signal synthesizer 24.

In a period from the time point t20 at the end of the arithmetic to a time point t50 at the end of the next arithmetic, the arithmetic unit 23 outputs a signal (the second output signal) from the arithmetic unit 23 to the signal synthesizer 24. The second output signal is used for generating a source signal corresponding to a calculated average voltage value.

In the display period T1 from the time point t20 to the time point 30, the signal synthesizer 24 outputs a source control signal to the source drive circuit 15. The source control signal is used for generating a source signal based on the video signal, and has the same waveform as the first output signal has. Moreover, in the suspension period T2 from the time point t30 to the time point t50, the signal synthesizer 24 outputs a source control signal to the source drive circuit 15. The source control signal is used for generating a source signal having the average voltage value, and has the same waveform as the second output signal has. Hence, the source drive circuit 15 supplies the thin-film transistors 11 with: the source signal based on the video signal in the display period T1; and the source signal having the average voltage value in the suspension period T2.

Moreover, in the suspension period T2, the controller 21 receives a new video signal from the host 101, and inputs the new video signal to the storage 22. Furthermore, in the suspension period T2, the arithmetic unit 23 calculates an average voltage value (grayscale) of a source signal in the display period T1*a* of the new video signal. Note that the polarity of the grayscale is reversed for every single frame. The same operations in the above display period T1 and suspension period T2 are repeated.

Here, in the suspension period in which the thin-film transistors are not ON, if a source electrode is set to a voltage value corresponding to the 0-level grayscale and a voltage value at the end of the display period, the pixel electrode has a voltage value written in the display period. Hence, a difference in potential is large between the source electrode and a drain electrode. Among the thin-film transistors, a deteriorating thin-film transistor worsens in OFF characteristics (decreases in threshold voltage). Even though the deteriorating thin-film transistor is OFF, current leaks between the drain electrode (the pixel electrode) and the source electrode, depending on the degree of the difference in potential between the drain electrode (the pixel electrode) and the source electrode. As a result, when the source electrode is set in the suspension period to a voltage value corresponding to the 0-level grayscale and a voltage value at the end of the display period, the potential of the pixel electrode varies such that variance in luminance increases and a bright spot appears. In contrast, according to the configuration disclosed in the first embodiment, the source signal having the average voltage value applies a voltage to the source electrode of each thin-film transistor 11. Such a configuration can reduce the difference in potential between the drain electrode (the pixel electrode 12) and the source electrode. As a result, even if some of the thin-film transistors 11 deteriorate and worsen in the OFF characteristics, the configuration of the first embodiment can reduce leakage of a current, and prevent variation in the potential of the pixel electrode 12. Such a feature can prevent an increase in variance of luminance and an appearance of a bright spot in the display device 100. As a result, the display device 100 can maintain display quality even if the thin-film transistors 11 deteriorate, while reducing power consumption.

Thanks to the above configuration, the storage 22 can store the video signal. Hence, the time point, at which the source signal based on the video signal is supplied from the storage 22 to the source drive circuit 15, can be delayed from the time point t10 to the time point t20. Such a feature can ensure a period for calculating an average voltage value of the source signal. The display period T1 can start at the time point t20 after the time point t10 at which the arithmetic unit 23 starts obtaining the video signal. Hence, at least within a period from the time point t10 to the time point t20, the arithmetic unit 23 can calculate the average voltage value. A difference between the average voltage value and a voltage value of the pixel electrode 12 is smaller than a difference between a mode voltage value and a voltage value of the pixel electrode (a configuration in a second embodiment). Hence, the display quality can further improve in the above feature than in the case where the mode value is calculated (the configuration in the second embodiment).

Second Embodiment

Figure 4:
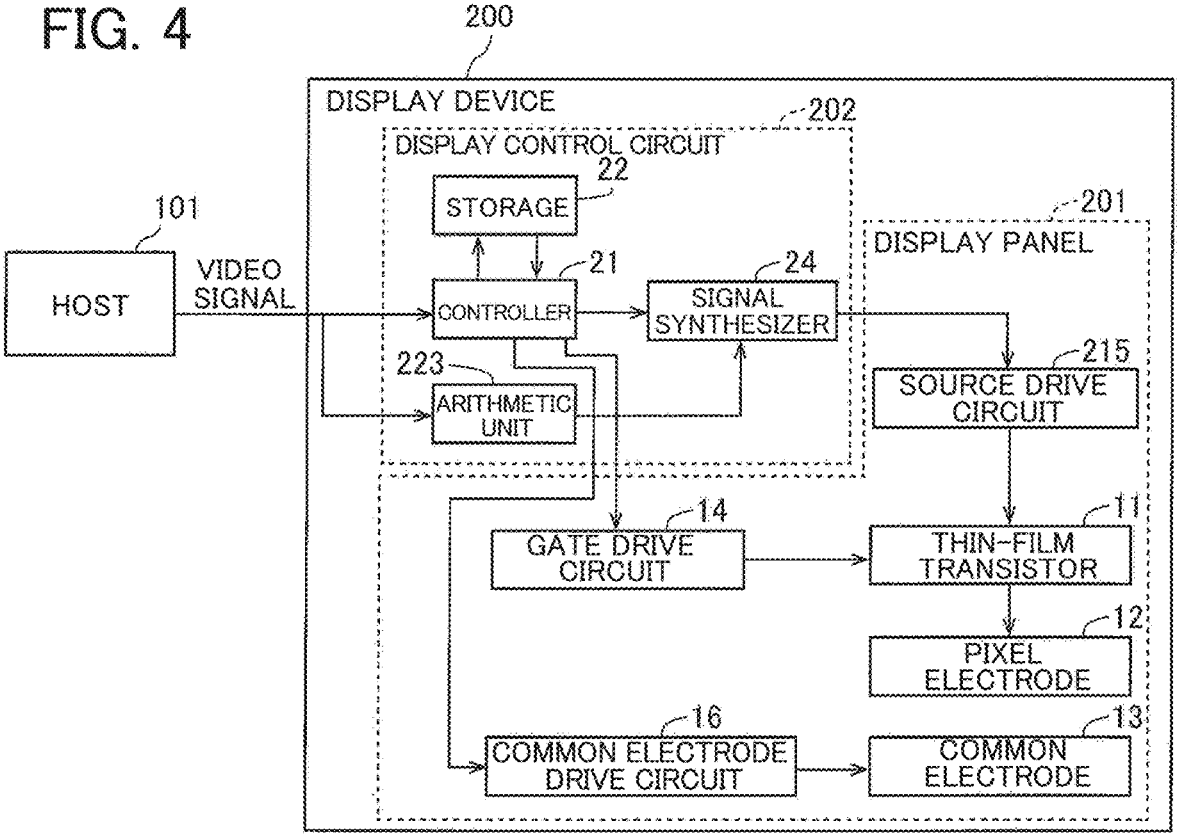
FIG. 4 is a block diagram illustrating a configuration of a display device according to a second embodiment.

Described next with reference to FIG. 4 is a display device 200 according to the second embodiment. In the display device 200 according to the second embodiment, an arithmetic unit 223 calculates a mode voltage value. In the suspension period T2, a source drive circuit 215 supplies the thin-film transistors 11 with a source signal having a mode voltage value. Note that, like reference signs designate identical components between this embodiment and the first embodiment. As to such components, previous description shall be referred to unless otherwise noted.

FIG. 4 is a block diagram illustrating a configuration of the display device 200 according to the second embodiment. As illustrated in FIG. 4, the display device 200 includes: a display panel 201 having a source drive circuit 215; and a display control circuit 202 having the arithmetic unit 223. The arithmetic unit 223 obtains a mode value of voltage values of a source signal in the display period T1*a* (see FIG. 3). Here, the "mode value" is the most frequently appeared value among the grayscale levels (the voltage values) in the display period T1*a*. For example, when the display panel 201 is provided with 1080 gate lines 14*a*, the arithmetic unit 223 obtains (extracts) the most frequently appeared value among 1080 data items in the display period T1*a*. For example, if the data of a 128-level grayscale (V128) appears most frequently, the second output signal is set to a voltage value of the 128-level grayscale (V128). Hence, in the suspension period T2, the source drive circuit 215 supplies the thin-film transistors 11 with a source signal having the mode voltage value.

Thanks to the configuration in the second embodiment, in the suspension period T2, the source signal having the mode voltage applies a voltage to the source electrode of each thin-film transistor 11. Such a configuration can reduce a difference in potential between the drain electrode (the pixel electrode 12) and the source electrode. As a result, even if some of the thin-film transistors 11 deteriorate and worsen in the OFF characteristics, the configuration of the second embodiment can reduce leakage of a current, and prevent variation in the potential of the pixel electrode 12. Such a feature can prevent an increase in variance of luminance and an appearance of a bright spot. As a result, the display device 200 can maintain display quality even if the thin-film transistors deteriorate, while reducing power consumption. Note that the other configuration and the advantageous effects of the second embodiment are the same as those of the first embodiment.

[Result of Comparison]

Figure 5:
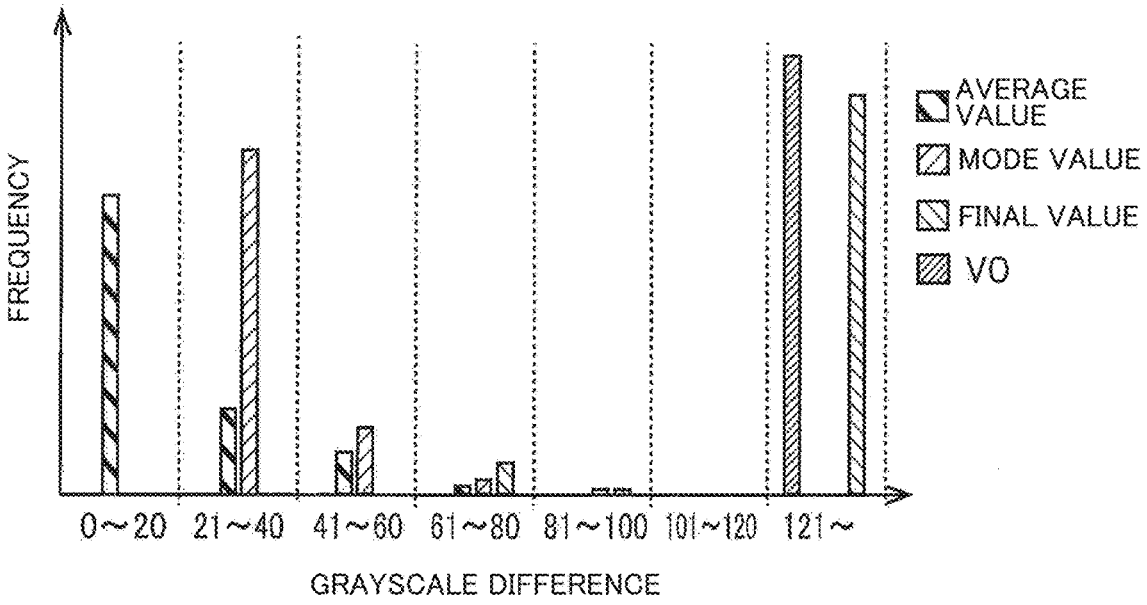
FIG. 5 illustrates a result of comparison between differences in grayscale of the display devices according to the first embodiment, the second embodiment, a first comparative example, and a second comparative example.
Figure 6:
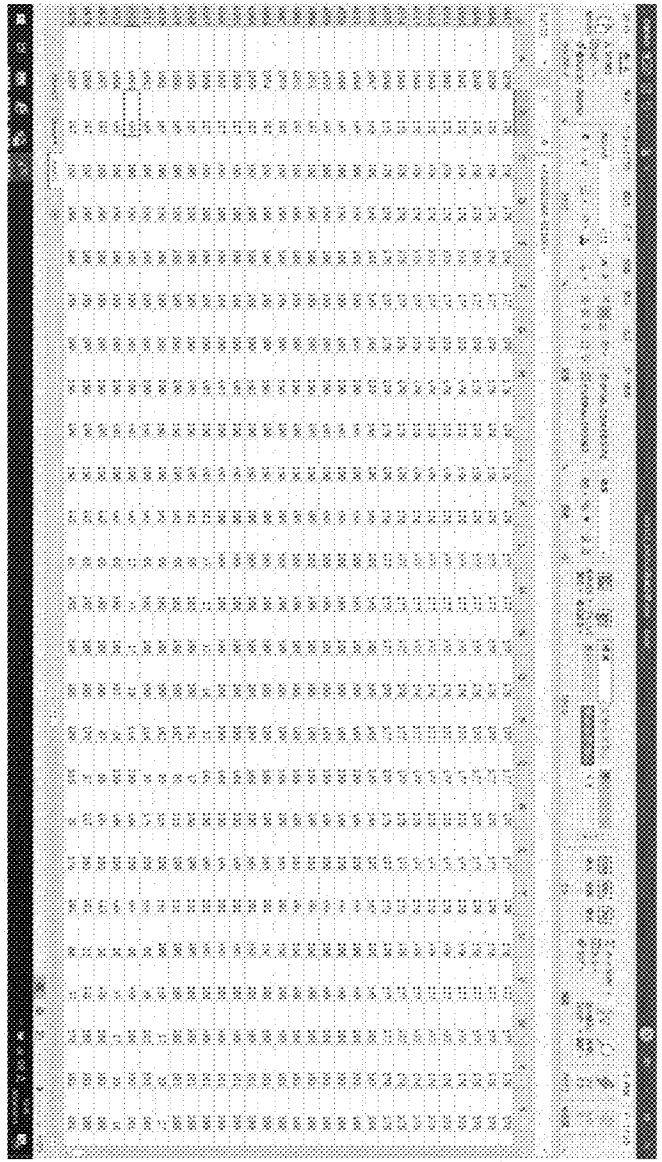
FIG. 6 shows an example of a screen used for obtaining the result of comparison.

Described next with reference to FIGS. 5 and 6 is a result of comparison between the display device 100 according to the first embodiment, the display device 200 according to the second embodiment, a display device according to a first comparative example, and a display device according to a second comparative example FIG. 5 illustrates the result of comparison (a result of a grayscale difference). FIG. 6 shows an example of a screen used for obtaining the result of comparison. In a suspension period, the display device 100 according to the first embodiment outputs, to thin-film transistors, an average voltage value of a source signal in a display period with respect to the screen in FIG. 6. In a suspension period, the display device 200 according to the second embodiment outputs, to thin-film transistors, a mode voltage value of a source signal in a display period with respect to the screen in FIG. 6. The display device according to the first comparative example outputs, to thin-film transistors, a source signal whose voltage value corresponds to a 0-level grayscale (V0) in a suspension period with respect to the screen in FIG. 6. The display device according to the second comparative example outputs a source signal, which is output at the end of a display period with respect to the screen in FIG. 6, to thin-film transistors also in a suspension period.

For each of the display device 100 according to the first embodiment, the display device 200 according to the second embodiment, the display device according to the first comparative example, and the display device according to the second comparative example, a difference value (a grayscale difference) is obtained between a grayscale level (a voltage value) of each pixel electrode and a grayscale level (a voltage value) of the source signal (the source electrode).

As illustrated in FIG. 5, both of the display devices according to the first and the second comparative examples most frequently exhibit a grayscale difference of 121 or more. The comparison shows that, in the display devices according to the first and the second comparative examples, a difference in potential is observed, in each of the thin-film transistors, between the source electrode and the pixel electrode that is connected to the drain electrode. As a result, when the thin-film transistors deteriorate and worsen in OFF characteristics in the display devices according to the first and the second comparative examples, current leaks between the drain electrode and the source electrode of each of the thin-film transistors because of the above potential difference. Hence, the potential of the pixel electrode varies, inevitably causing variation in luminance and appearance of a bright spot.

In contrast, neither the display device 100 according to the first embodiment nor the display device 200 according to the second embodiment makes a grayscale difference of 121 or more. FIG. 5 shows that, in the display device 100 according to the first embodiment and the display device 200 according to the second embodiment, the potential difference is small, in each of the thin-film transistors, between the source electrode and the pixel electrode that is connected to the drain electrode. In particular, in the display device 100 according to the first embodiment, a grayscale difference of 0 or more and 20 or less appears most frequently. FIG. 5 shows that, compared with the display device 200 according to the second embodiment whose grayscale difference of 21 or more and 40 or less appears most frequently, the display device 100 exhibits a smaller potential difference, in each of the thin-film transistors, between the source electrode and the pixel electrode that is connected to the drain electrode. As a result, even if the thin-film transistors 11 deteriorate and worsen in OFF characteristics, such features can prevent a current from leaking between the drain electrode and the source electrode of each thin-film transistor 11, making it possible to prevent variation in luminance and appearance of a bright spot.

Modifications

The above embodiments are examples of the present disclosure. Hence, the present disclosure shall not be limited to the above embodiments. Unless otherwise departing from the scope of the present disclosure, the above embodiments may be modified appropriately for their implementation.

In the first and the second embodiments, for example, the display control circuit may be provided with the storage. However, the present disclosure shall not be limited to such an example. That is, if the processing speed of the arithmetic unit is sufficiently faster than the scan of the gate signal, the storage does not have to be provided. In the first and the second embodiments, for example, the display control circuit may include therein the storage. However, the present disclosure shall not be limited to such an example. For example, the storage may be externally provided to the display device.

In the first and the second embodiments, for example, the timing t20 to start the display period T1 synchronizes with the time point t20 at which the display period T1*a* ends. However, the present disclosure shall not be limited to such an example. For example, the timing to start the display period T1 may be either before or after the time point t20 at which the display period T1*a* ends.

The above display devices and a method for controlling the display devices may be described below.

A display device according to a first configuration includes: a plurality of gate lines; a plurality of source lines arranged to intersect with the gate lines; a plurality of thin-film transistors connected to the gate lines and the source lines; a plurality of pixel electrodes connected to the thin-film transistors; a gate drive circuit sequentially supplying a gate signal to the gate lines; a source drive circuit supplying a source signal to the source lines, and performing column-inversion drive to reverse a polarity of a voltage of the source signal for every one frame period; and a display control circuit controlling the gate drive circuit and the source drive circuit. The one frame period includes: a display period for sequentially supplying the gate signal to the gate lines; and a suspension period for suspending supply of the gate signal. The display control circuit includes: an arithmetic unit obtaining a video signal, and calculating, in accordance with the video signal, an average voltage value or a mode voltage value of the source signal in the display period, the average voltage value or the mode voltage value being calculated for each of the source lines; and a source controller supplying, in the display period, the source signal, based on the video signal, from the source drive circuit to the source lines, and supplying, in the suspension period, a source signal, having the average voltage value or the mode voltage value calculated by the arithmetic unit, from the source drive circuit to each of the source lines (the first configuration).

Thanks to the first configuration, the column-inversion drive can further reduce power consumption of the display device than the dot-inversion drive does. Here, if the source electrode is set to a voltage value corresponding to a 0-level grayscale and a voltage value at the end of the display period, in the suspension period in which the thin-film transistors are not ON, the pixel electrode has a voltage value written in the display period. Hence, a potential difference between the source electrode and the drain electrode is large. Then, of the thin-film transistors, a deteriorating thin-film transistor worsens in OFF characteristics (a threshold voltage drops). Even though the deteriorating thin-film transistor is OFF, current leaks between the drain electrode (the pixel electrode) and the source electrode, depending on a degree of the potential difference between the drain electrode (the pixel electrode) and the source electrode. As a result, if, in the suspension period, the source electrode is set to the voltage value corresponding to the 0-level grayscale and the voltage value at the end of the display period, the potential of the pixel electrode varies. Hence, variation in luminance increases, and a bright spot appears. In contrast, according to the first configuration, in the suspension period, the source signal having an average voltage value or a mode voltage value applies a voltage to the source electrode of each of the thin-film transistors. Such a feature can reduce a potential difference between the drain electrode (the pixel electrode) and the source electrode. As a result, even if some of the thin-film transistors deteriorate and worsen in OFF characteristics, the feature can reduce leakage of a current and prevent variation in the potential of the pixel electrode. Hence, the feature can prevent an increase in variation of luminance, and an appearance of a bright spot. As a result, the display device can maintain display quality even if a thin-film transistor deteriorates, while reducing power consumption.

In the first configuration, the display control circuit may further include a storage storing the video signal. The source controller may supply, in the display period, the source signal, based on the video signal stored on the storage, from the source drive circuit to the source lines, and may supply, in the suspension period, the source signal, having the average voltage value or the mode voltage value calculated by the arithmetic unit, from the source drive circuit to each of the source lines (a second configuration).

Thanks to the second configuration, the storage can store the video signal. Such a feature can delay a time point at which the source drive circuit is supplied with the source signal, based on the video signal, from the storage. The feature can readily ensure a time period for calculating the average voltage value or the mode voltage value of the source signal.

In the second configuration, the display control circuit may further include a gate controller causing the gate drive circuit to sequentially supply the gate signal to the gate lines at a second time point after a first time point at which the video signal starts to be obtained. The storage may output, at the second time point, a first output signal based on the video signal stored on the storage. The arithmetic unit may output, after the second time point, a second output signal having the average voltage value or the mode voltage value calculated by the arithmetic unit. The source controller may include a signal synthesizer synthesizing the first output signal and the second output signal into a signal for each of the source lines, and outputting, to the source drive circuit, the signal serving as a source control signal (a third configuration).

Thanks to the third configuration, the display period can be started at the second time point after the first time point at which the video signal starts to be obtained. Such a feature allows the arithmetic unit to calculate the average voltage value or the mode voltage value at least within a period from the first time point to the second time point.

In any one of the first to third configurations, the arithmetic unit may calculate the average voltage value for each of the source lines, based on the obtained video signal. In the suspension period. The source controller may supply the source signal, having the average voltage value calculated by the arithmetic unit, from the source drive circuit to each of the source lines (a fourth configuration).

Thanks to the fourth configuration, a difference between the average voltage value and a voltage value of the pixel electrode is smaller than a difference between the mode voltage value and the voltage value of the pixel electrode.

Hence, the display quality can further improve in the above configuration than in a case where the mode value is calculated.

In a method for controlling a display device according to a fifth configuration, the display device includes: a plurality of gate lines; a plurality of source lines arranged to intersect with the gate lines; a plurality of thin-film transistors connected to the gate lines and the source lines; and a plurality of pixel electrodes connected to the thin-film transistors. The method includes: a step of sequentially supplying a gate signal to the gate lines; and a step of supplying a source signal to the source lines. The step of supplying the source signal includes a step of performing column-inversion drive to reverse a polarity of a voltage of the source signal for every one frame period. The one frame period includes: a display period for sequentially supplying the gate signal to the gate lines; and a suspension period for suspending supply of the gate signal. The method further includes: a step of obtaining a video signal, and calculating, based on the video signal, an average voltage value or a mode voltage value of the source signal in the display period, the average voltage value or the mode voltage value being calculated for each of the source lines; and a step of supplying, in the display period, the source signal, based on the video signal, to the source lines, and supplying, in the suspension period, a source signal, having the average voltage value or the mode voltage value calculated in the step of calculating, to each of the source lines (the fifth configuration).

Thanks to the fifth configuration, as seen in the first configuration, the display device can maintain display quality even if a thin-film transistor deteriorates, while reducing power consumption.

The invention claimed is:

1. A display device, comprising:

a plurality of gate lines;

a plurality of source lines arranged to intersect with the gate lines;

a plurality of thin-film transistors connected to the gate lines and the source lines;

a plurality of pixel electrodes connected to the thin-film transistors;

a gate drive circuit configured to sequentially supply a gate signal to the gate lines;

a source drive circuit configured to supply a source signal to the source lines, and to perform column-inversion drive to reverse a polarity of a voltage of the source signal for every one frame period; and a display control circuit configured to control the gate drive circuit and the source drive circuit, wherein the one frame period includes: a display period for sequentially supplying the gate signal to the gate lines; and a suspension period for suspending supply of the gate signal, the display control circuit includes:

an arithmetic unit configured to obtain a video signal, and to calculate, in accordance with the video signal, an average voltage value or a mode voltage value of the source signal in the display period, the average voltage value or the mode voltage value being calculated for each of the source lines; and a source controller configured to supply, in the display period, the source signal, based on the video signal, from the source drive circuit to the source lines, and to supply, in the suspension period, a source signal, having the average voltage value or the mode voltage value calculated by the arithmetic unit, from the source drive circuit to each of the source lines;

in the display period, a signal having a same waveform as the first output signal is output; and in the suspension period, a source signal having the average voltage value or the mode voltage value is output.

2. The display device according to claim 1, wherein the display control circuit further includes a storage configured to store the video signal, and the source controller supplies, in the display period, the source signal, based on the video signal stored on the storage, from the source drive circuit to the source lines, and supplies, in the suspension period, the source signal, having the average voltage value or the mode voltage value calculated by the arithmetic unit, from the source drive circuit to each of the source lines.

3. The display device according to claim 2, wherein the display control circuit further includes a gate controller configured to cause the gate drive circuit to sequentially supply the gate signal to the gate lines at a second time point after a first time point at which the video signal starts to be obtained, the storage outputs, at the second time point, a first output signal based on the video signal stored on the storage, the arithmetic unit outputs, after the second time point, a second output signal having the average voltage value or the mode voltage value calculated by the arithmetic unit, and the source controller includes a signal synthesizer configured to synthesize the first output signal and the second output signal into a signal for each of the source lines, and to output, to the source drive circuit, the signal serving as a source control signal.

4. The display device according to claim 1, wherein the arithmetic unit calculates the average voltage value for each of the source lines, based on the obtained video signal, and in the suspension period, the source controller supplies the source signal, having the average voltage value calculated by the arithmetic unit, from the source drive circuit to each of the source lines.

5. The display device according to claim 1, wherein in the suspension period, the source controller is configured to supply the source signal having the mode voltage value calculated by the arithmetic unit from the source drive circuit to each of the source lines.

6. A method for controlling a display device including: a plurality of gate lines; a plurality of source lines arranged to intersect with the gate lines; a plurality of thin-film transistors connected to the gate lines and the source lines; and a plurality of pixel electrodes connected to the thin-film transistors, the method comprising:

a step of sequentially supplying a gate signal to the gate lines; and a step of supplying a source signal to the source lines, wherein the step of supplying the source signal includes a step of performing column-inversion drive to reverse a polarity of a voltage of the source signal for every one frame period, the one frame period includes: a display period for sequentially supplying the gate signal to the gate lines; and a suspension period for suspending supply of the gate signal, the method further includes:

a step of obtaining a video signal, and calculating, based on the video signal, an average voltage value or a mode voltage value of the source signal in the display period, the average voltage value or the mode voltage value being calculated for each of the source lines; and a step of supplying, in the display period, the source signal, based on the video signal, to the source lines, and supplying, in the suspension period, a source signal, having the average voltage value or the mode voltage value calculated in the step of calculating, to each of the source lines;

in the display period, a signal having a same waveform as the first output sign is output; and in the suspension period, a source signal having the average voltage value or the mode voltage value is Output.

7. The method for controlling a display device according to claim 6, wherein in the suspension period, the source controller is configured to supply the source signal having the mode voltage value calculated by the arithmetic unit from the source drive circuit to each of the source lines.

* * * * *